United States Patent [19]

Dougherty

[11] Patent Number: 4,601,150

[45] Date of Patent: Jul. 22, 1986

[54] ROOFING ELEMENT AND ROOF EMPLOYING SUCH ELEMENT

[75] Inventor: Cathy W. Dougherty, Reynoldsburg, Ohio

[73] Assignee: The Dow Chemical Company, Midland, Mich.

[21] Appl. No.: 697,816

[22] Filed: Feb. 4, 1985

[51] Int. Cl.[4] ..... E04C 1/40

[52] U.S. Cl. ..... 52/309.12; 52/318; 404/18

[58] Field of Search ..... 52/384–389, 52/515, 516, 309.12, 309.4, 404, 408, 318; 404/18

[56] References Cited

U.S. PATENT DOCUMENTS

| | | | |
|---|---|---|---|
| 720,836 | 2/1903 | Munro | 52/388 |
| 790,260 | 5/1905 | Munro | 52/388 |
| 1,632,497 | 6/1927 | Noel | 404/18 |
| 3,238,682 | 3/1966 | Tracy et al. | 404/18 |
| 3,335,048 | 8/1967 | Morain | 52/389 |
| 3,411,256 | 11/1968 | Best | 52/515 |
| 3,817,012 | 6/1974 | Wack et al. | 52/385 |
| 4,054,691 | 10/1977 | McMillan | 427/390 |
| 4,067,164 | 1/1978 | McMillan | 52/309.2 |
| 4,351,138 | 9/1982 | McMillan et al. | 52/309.4 |
| 4,432,177 | 2/1984 | Amesso et al. | 52/388 |

FOREIGN PATENT DOCUMENTS

| | | | |
|---|---|---|---|
| 2404085 | 5/1979 | France | 52/408 |

*Primary Examiner*—James L. Ridgill, Jr.
*Attorney, Agent, or Firm*—Robert B. Ingraham

[57] ABSTRACT

A roofing panel is provided comprising a layer of closed cell plastic foam and a layer of mortar. A reinforcing grid is disposed within the mortar layer.

12 Claims, 13 Drawing Figures

ROOFING ELEMENT AND ROOF EMPLOYING SUCH ELEMENT

Many buildings employ so-called flat roofs. Such roofs for many purposes are entirely satisfactory and generally are economical to install. As energy costs increase, thermal insulation of such roofs becomes increasingly desirable. One particularly desirable mode of insulating a flat roof is set forth in U.S. Pat. No. 3,411,256 issued to J. S. Best. U.S. Pat. No. 3,411,256 disclosed the insulation of a flat roof by applying generally rectangular slabs of closed cell synthetic resinous foam over the waterproof membrane of the flat roof and subsequently applying to the slabs of closed cell synthetic resinous foam a layer of gravel or inorganic mortar to provide protection of the organic resinous foam from light, and therefore prevent deterioration of the foam from the effect of ultraviolet radiation and the like. Such roofs, if properly installed, provide highly desirable insulation and protection of the roof waterproof membrane. However, where loose gravel is employed as ballast and as an ultraviolet protective layer, the resultant roof is not well adapted for foot traffic. Occasional foot traffic will result in minor and insignificant damage to the foam caused by localized loading by the particulate gravel. However, as the foot traffic increases, damage to the foam also may increase to a level wherein the thermal insulation qualities of the foam layer deteriorate. Such roofs are generally satisfactory for most locations providing that the gravel size is selected to at least match local wind conditions wherein the gravel size is chosen to be sufficiently large that significant displacement of the gravel does not occur under high wind conditions.

In U.S. Pat. Nos. 4,054,691 and 4,067,164, roof insulating members are disclosed wherein a mortar layer is applied over a synthetic resinous foam layer and adhered thereto. The use of mortar layer can replace the gravel layer of the hereinbefore cited Best patent. Such a mortar layer generally provides increased resistance to damage by foot traffic when the mortar layer is of adequate thickness; adequate thickness of the mortar layer depends upon the particular density and strength of the synthetic resinous foam employed and the strength of the particular mortar formulation employed.

In the preparation of roofs using a layer of synthetic resinous closed cell foam over a water impermeable membrane of the roof, consideration must be given to the configuration of the roof, potential wind conditions, and the like. For example, in the event that the roof, although normally flat, exhibits one or more depressions, during and after rain water may accumulate in a quantity sufficient to cause flotation of the insulating members. Relative movement of such members may occur particularly under the influence of wind where one panel may be forced partially over an adjacent panel. One technique of avoiding such difficulty is set forth in U.S. Pat. No. 4,351,138 issued to William J. McMillan et al. In U.S. Pat. No. 4,351,138, insulating elements of closed cell synthetic resinous foam are applied to the roof, a water permeable sheet such as a scrim is applied over the thermally insulating elements and an appropriate ballast such as gravel is applied over the scrim. Such a roof structure has improved resistance to foot traffic, but in most instances such resistance to foot traffic is not as great as obtained when a mortar layup is employed over synthetic resinous closed cell insulating elements.

For many applications, significant resistance to foot traffic on a roof is desired. When a laminate of mortar and synthetic resinous foam is employed, such laminates are subject to the hereinbefore delineated disadvantages.

It would be desirable if there were available an improved cementitious mortar-synthetic resinous foam laminate which would exhibit improved physical properties.

It would also be desirable if there were available an improved cementitious mortar-synthetic resinous foam laminate having increased resistance to handling.

It would also be desirable if there were available an improved cementitious mortar-synthetic resinous closed cell foam laminate having improved resistance to foot traffic and handling.

It would also be desirable if such a laminate were available having improved resistance to cracking when flexed.

It would also be desirable if there were available an improved roof structure utilizing such a laminate.

These benefits and other advantages in accordance with the present invention are achieved in a laminate of an inorganic mortar and a closed cell synthetic resinous layer of generally planar configuration wherein a cementitious layer is affixed to synthetic resinous foam layer to provide a laminate generally resistant to foot traffic when the cementitious layer is positioned in an uppermost position, the improvement which comprises incorporating within the cementitious layer a reticulate sheet, the sheet having a plurality of openings defined therein wherein the area of the openings is from about 50 to 98 percent of the area of a major surface of the reticulate sheet, the openings extending between first and second major surfaces of the reticulate sheet.

Also contemplated within the scope of the present invention is a generally planar roof comprising: a roof deck, the roof deck having disposed thereon a water impermeable membrane, a plurality of laminated bodies disposed over and covering said water impermeable membrane, the laminated bodies comprising a layer of synthetic resinous closed cell foam, a layer of inorganic cementitious material disposed on at least one major surface of the synthetic resinous foam, the synthetic resinous foam being disposed adjacent the water impermeable membrane, the cementitious layer generally remote from the water impermeable membrane, the improvement which comprises a reticulate sheet disposed within the cementitious inorganic layer, the reticulate sheet defining a plurality of openings extending from one major face of the reticulate sheet to an opposite major face of the reticulate sheet wherein the area of the openings is from about 50 to 98 percent of the total area of a major surface of the reticulate sheet.

Further features and advantages of the present invention will become more apparent in the following specification taken in connection with the drawing wherein.

Figure 1:
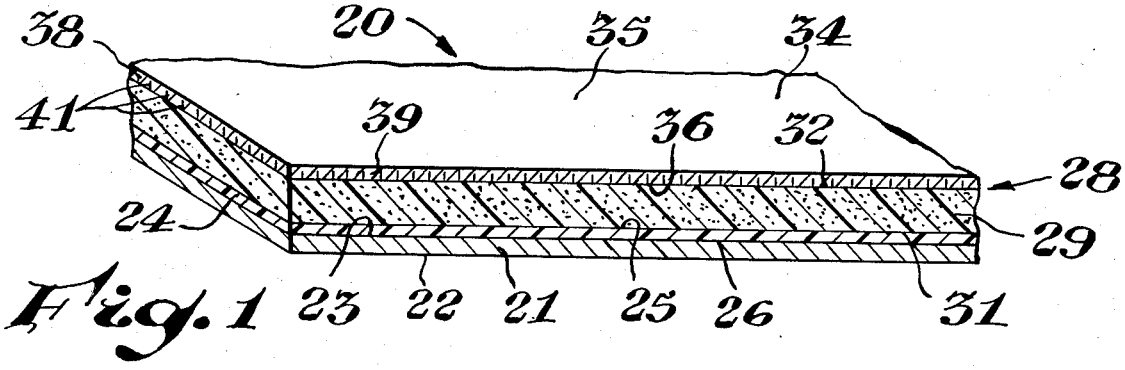
FIG. 1 is a schematic fractional sectional view of a roof in accordance with the present invention.

In FIG. 1 there is schematically depicted a fractional schematic view of a portion of a roof in accordance with the present invention, generally designated by the reference numeral 20. The roof 20 comprises in cooperative combination a roof deck 21 having a lower side 22 and an upper side 23. The roof deck 20 has disposed on the upper side 23 thereof a water impermeable membrane 24. The water impermeable membrane 24 may be of any conventional construction including synthetic resinous thermoplastic film or sheeting, or alternatively it may be made up of one or more layers of roofing felt and bituminous tar material as is conventionally employed in the preparation of the so-called "built-up" roofs. The membrane 24 has an upper side 25 and a lower side 26. The lower side 26 is disposed immediately adjacent the upper side 23 of the roof deck 21. The roof deck 21 and the water impermeable membrane 24 optionally may be adhered to each other or not, depending upon the ultimate requirements of the roof structure. A composite insulating and wear layer generally designated by the reference numeral 28 is disposed on the upper surface 25 of the water impermeable membrane 24. The insulating composite layer 28 comprises a first closed cell thermally insulating synthetic resinous foam slab or plank 29 having a lower surface 31. The lower surface 31 of the composite layer 28 is disposed on the upper surface 25 of the water impermeable membrane 24. The synthetic resinous foam layer 29 has a second or upper surface 32 disposed remote from the upper surface 25 of the water impermeable membrane 24. A composite cementitious layer 34 is disposed on the upper surface 32 of the thermally insulating layer 29. The layer 34 has an upper surface 35 and a lower surface 36. The lower surface 36 of the cementitious layer 34 is disposed immediately adjacent the upper surface 32 of the insulating layer 29. The composite layer 34 comprises a cementitious matrix 38 having disposed therein a recticulate reinforcing sheet 39 having a plurality of exposed portions 41.

Figure 2:
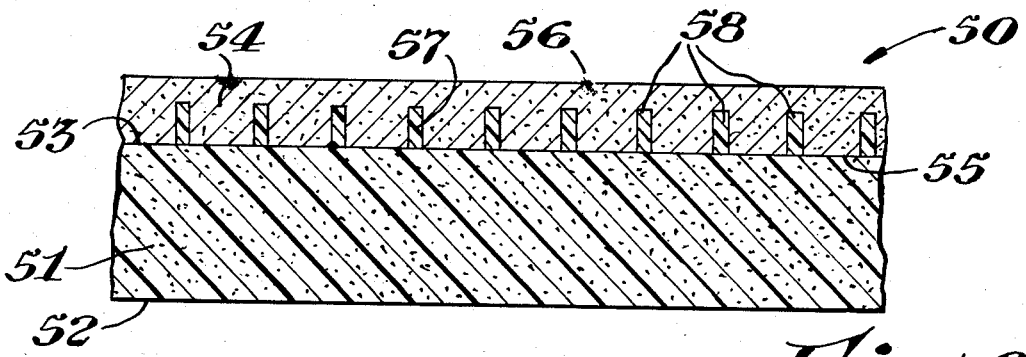
FIG. 2 is a sectional view of a laminate in accordance with the invention.

In FIG. 2 there is schematically depicted a sectional view of a composite roofing panel in accordance with the present invention generally designated by the reference numeral 50. The panel 50 comprises a generally planar synthetic resinous thermally insulating foam layer 51 having a lower or first surface 52 and a second or upper surface 53. The surface 53 is adapted to be supported by a surface such as the surface 25 of the water impermeable membrane 24 of FIG. 1. The layer 51 is of closed cell configuration. A cementitious composite layer 54 is disposed on and affixed to the closed cell insulating layer 51 and is in contact with the surface 53 thereof. The composite layer 54 has a lower surface 55 which engages the surface 53 of the layer 51. The second or upper surface 56 of the layer 54 is disposed remote from the surface 53 of the cellular thermally insulating or plastic foam layer 51. Disposed generally within the cementitious layer 54 is a reticulate reinforcing sheet 57. A plurality of portions 58 of the reticulate reinforcing member 57 is exposed in the sectional representation of FIG. 2.

Figure 3:
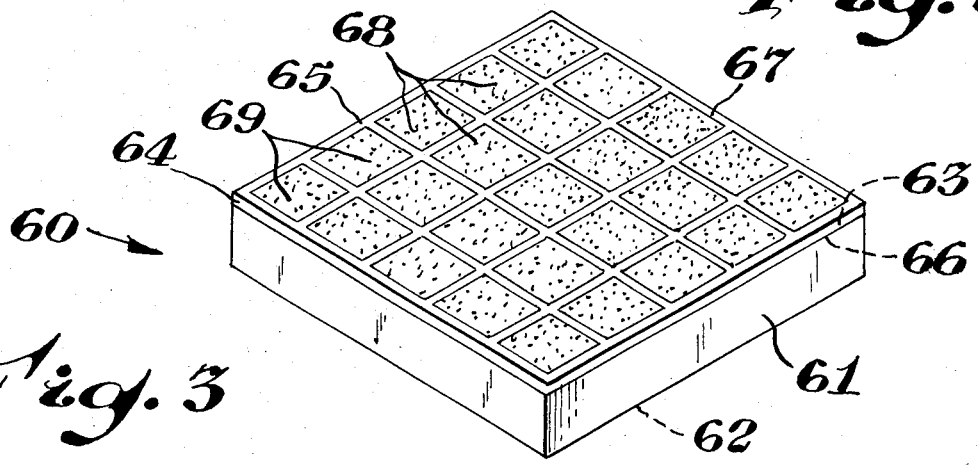
FIG. 3 is an isometric view of an alternate laminate in accordance with the present invention.

In FIG. 3 there is schematically depicted a schematic view of a roof insulating and foot traffic resistant panel in accordance with the present invention generally designated by the reference numeral 60. The panel 60 comprises two layers; the first or lowermost layer as depicted in FIG. 3 comprises a closed cell thermally insulating synthetic resinous foam layer generally designated by the reference numeral 61. The layer 61 has a lower surface 62 and an upper surface 63. Disposed upon the surface 63 of the insulating layer 61 is a composite cementitious layer 64. The layer 64 comprises a reticulate sheet 65 having a lower surface 66 and an upper surface 67. A plurality of passages 68 within the sheet 67 extend from the upper surface 67 to the lower surface 66. The passages 68 are filled with cementitious material designated by the reference numeral 69.

Figure 4:
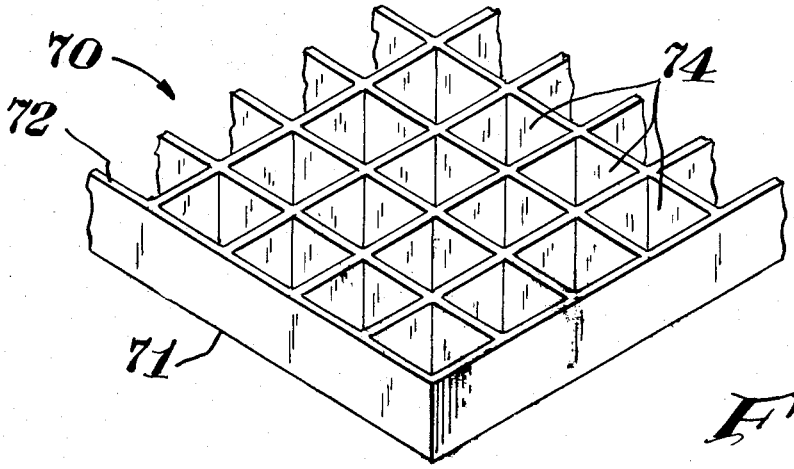
FIG. 4 is an isometric fractional view illustration of a reticulate sheet or slab in accordance with the present invention.

FIG. 4 schematically depicts a fractional section isometric view of a reticulate sheet useful in the practice of the present invention generally designated by the reference numeral 70. The sheet 70 is of generally planar configuration and has a lower surface 71 and an upper surface 72, the surfaces 71 and 72 being generally parallel to each other. The sheet 70 defines a plurality of passages 74 extending between surfaces 71 and 72, the passages having the configuration of a generally rectilinear solid. As depicted in FIG. 4, the passages 74 are of generally equal dimensions.

Figure 5:
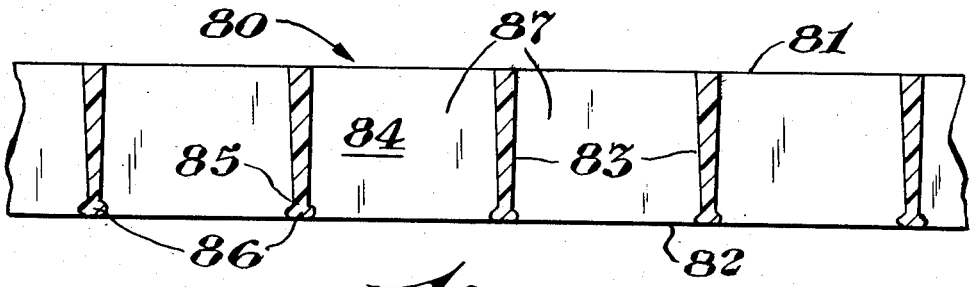
FIG. 5 is a fractional sectional view of a reticulate sheet for the present invention.

In FIG. 5 there is schematically depicted a fractional sectional view of a reticulated sheet or plate useful in the practice of the present invention generally designated by the reference numeral 80. The plate 80 has a first or upper side 81 and a second or lower side 82. The plate 80 comprises a first plurality of rib members 83 which extend generally parallel to each other and are in spaced apart relationship. A second plurality of spaced apart rib members designated by the reference numeral 84, only one shown, extend generally normal to the rib members 83 to form a grid-like configuration such as depicted in FIG. 4. The rib members 83 and 84 have a cross sectional configuration as depicted for the rib members 83. The rib members 83 taper in cross sectional configuration from the upper surface 81 to a location 85 generally adjacent the lower surface 82 and terminate in an enlarged or bulbous portion 86 generally adjacent the lower surface 82. Advantageously reinforcing reticulate sheets or grids such as the grid 80 are fabricated by the injection molding of synthetic resinous material to form a reticulate sheet or grid wherein the rib members such as 83 and 84 smoothly taper to a minimal thickness dimension at a location remote from the upper surface 81. At some time after the injection molding of such a grid or reticulate sheet, a surface generally corresponding to the surface 82 is contacted with a heated surface such as a platen at a temperature sufficient to cause softening of the material forming the reticulate sheet and by the application of pressure, the reticulate sheet is deformed adjacent the surface 82 to result in enlarged or bulbous edge 86. The taper of the members 83 and 84 is primarily a matter of convenience for the injection molding operation. The formation of the bulbous portion corresponded to portion 86 of the member 83 provides a desirable mechanical lock to retain cementitious materials which are subsequently disposed in passages 87 defined in the reticulate sheet 80. The passages 87 are of generally reclinear configuration and extend from the first face 81 to the second face 82 of the sheets 80.

Figure 6:
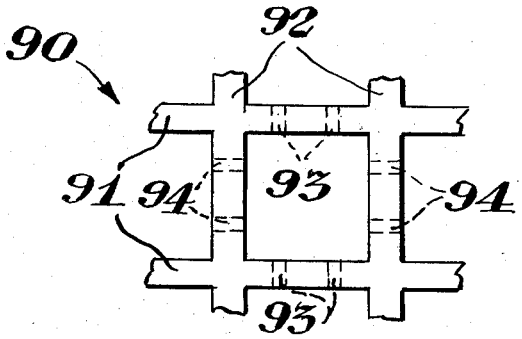
FIGS. 6 and 7 are two fractional views of a reticulate sheet useful in the present invention.

FIG. 6 depicts a fraction face view of an alternate embodiment of a reticulate sheet useful in the practice of the present invention generally designated by the reference numeral 90. The sheet 90 comprises a first plurality of generally bar-like elements designated by the numeral 91 which extend parallel to each other and are spaced apart. A second series of generally bar-like elements of generally like configuration to the elements 91 extend generally normal thereto and are integrally joined at locations of intersection. The bar-like elements 91 define a first plurality of passageways 93. The passageways 93 extend entirely through the bar-like elements 91 and extend in a direction normal thereto. The bar-like elements 92 define a plurality of passageways 94 of generally like configuration to the passageways 93.

Figure 7:
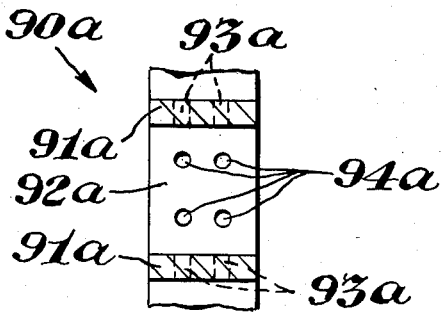

FIG. 7 depicts a fractional edge view of a reticulate sheet generally indicated by the reference numeral 90*a*. The sheet 90*a* has a plurality of bar-like elements 91*a* corresponding to the elements 91 of sheet 90 of FIG. 6. The bar-like elements 91*a* define a plurality of passages 93*a*. A second plurality of bar-like elements, only one shown, designated by the numeral 92*a* extend generally perpendicular and intersect with bar-like elements 91*a*. Bar-like elements 92*a* define therein a plurality of transverse passages designated by the reference numeral 94*a*. In the embodiment of reticulate sheet useful in the practice of the present invention as depicted in FIGS. 6 and 7, the passages 93, 93*a*, 94 and 94*a* provide locations into which uncured cementitious material enters, is cured, and maintains the cementitious material in fixed relationship to the reticulate sheet.

Figure 8:
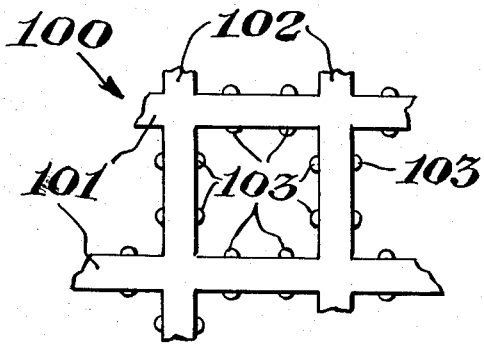
FIGS. 8 and 9 are two views of an alternate reticulate sheet useful in the practice of the present invention.

In FIG. 8 there is depicted a schematic fraction face view of a portion of a reticulate sheet useful for the practice of the present invention generally designated by the reference numeral 100. The sheet 100 comprises a first plurality of bar-like elements 101, the bar-like elements 101 being in spaced apart generally parallel relationship to each other. A second plurality of bar-like elements 102 extend in a direction generally normal to bar-like elements 101. The bar-like elements 101 and 102 are of generally like cross sectional configuration and dimension and are integrally joined at locations of intersection, the bar-like elements 101 and 102 having disposed thereon a plurality of protuberances generally designated by the reference numeral 103. The protuberances 103 are generally rigidly affixed to the bar-like elements 101 and 102.

Figure 9:
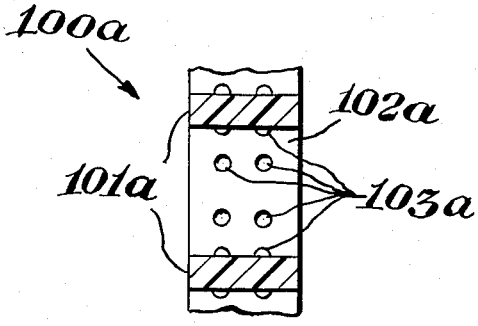

FIG. 9 schematically depicts a fractional sectional view of a reticulate sheet generally designated by the reference numeral 100*a*. Sheet 100*a* has spaced apart bar-like elements 101*a* and second spaced apart bar-like elements 102*a*, only one shown, extending generally normal to the elements 101*a*. The bar-like elements 101*a* and 102*a* define a plurality of protuberances 103*a* rigidly affixed thereto. The reticulated sheets 100 and 100*a* as depicted in FIGS. 8 and 9 provide an alternate means of providing a mechanical lock between cementitious material disposed in spaces defined by the bar-like members such as the bar-like members 101 and 102 and 101*a* and 102*a* when the cementitious material has hardened.

Figure 10:
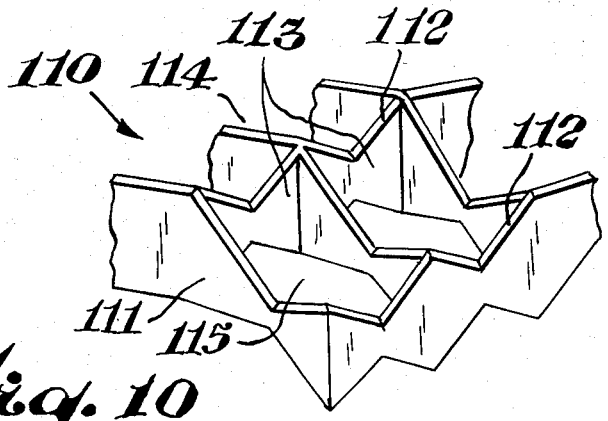
FIG. 10 is a fractional isometric representation of a reticulate sheet useful in the practice of the invention.

In FIG. 10 there is depicted a fragmentary isometric view of an alternate embodiment of a reticulate sheet useful in the practice of the present invention generally designated by the reference numeral 110. The sheet 110 comprises a first plurality of parallel bar-like members designated by the reference numeral 111. A second plurality of generally bar-like members designated by the reference numeral 112 extend generally normal thereto. The dimensions of the bar-like members 111 and 112 are generally alike and the bar-like members 111 and 112 are joined at locations of intersection. The members 111 and 112 define passageways 113 extending generally normal to the longitudinal dimensions of the bar-like members 111 and 112. Passageways 113 provide communication between a first side 114 and a second side 115 of the reticulate plate-like member 110. Each of the bar-like members 111 and 112 comprise a plurality of truncated triangular members wherein the apexes of the triangular members have been truncated. The triangular members in essence are joined base to base and apex to apex, thereby providing a reticulated sheet which is continuous and when disposed in a cementitious matrix, the matrix may be continuous as in the embodiment of the invention depicted in FIGS. 6 and 7. The embodiment of FIG. 10 is more suitable for employment with stiffer or more flow resistant cementitious masses than is the embodiment shown in FIGS. 6 and 7.

Figure 11:
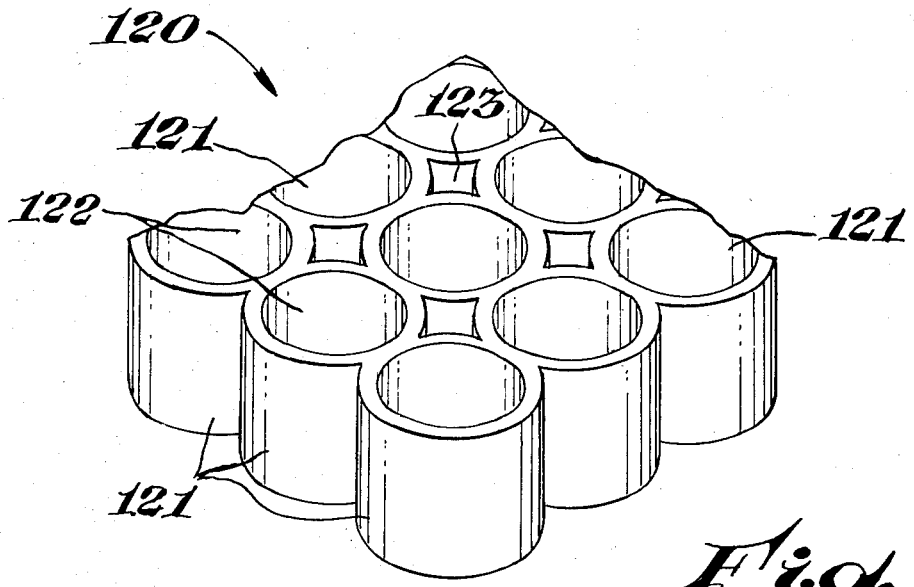
FIG. 11 is a fractional isometric view of a reticulate sheet useful in the practice of the present invention having generally cylindrical cells.

In FIG. 11 there is depicted a fractional isometric view of an alternate embodiment of a reticulate sheet suitable for the practice of the present invention generally designated by the reference numeral 120. The sheet 120 for purposes of visualization comprises a plurality of generally equally dimensional hollow cylindrical members or cells 121, the members 121 being arranged in square close packed configuration with their axes of generation generally parallel and each of the cells 121 fused or otherwise affixed to adjacent cells 121. Each of the hollow cylindrical members defines generally cylindrical passages 122 extending in the direction generally normal to major surfaces of such a sheet. Each adjacent 4 cells 121 define therebetween 4-cornered passageways 123. Reticulate sheets such as the sheets 120 can be formed by conventional injection molding procedures wherein the walls of the cells 121 would taper for ease of mold release or alternatively such sheets are prepared from thermoplastic tubing by cutting cylindrical elements of equal length and subsequently fusing such elements together. Alternatively, the thermoplastic, nonthermoplastic, metallic or ceramic cylindrical elements are utilized. Adjacent elements are readily joined by means of conventional adhesives such as alpha-cyanoacrylates, epoxies, and the like.

Figure 12:
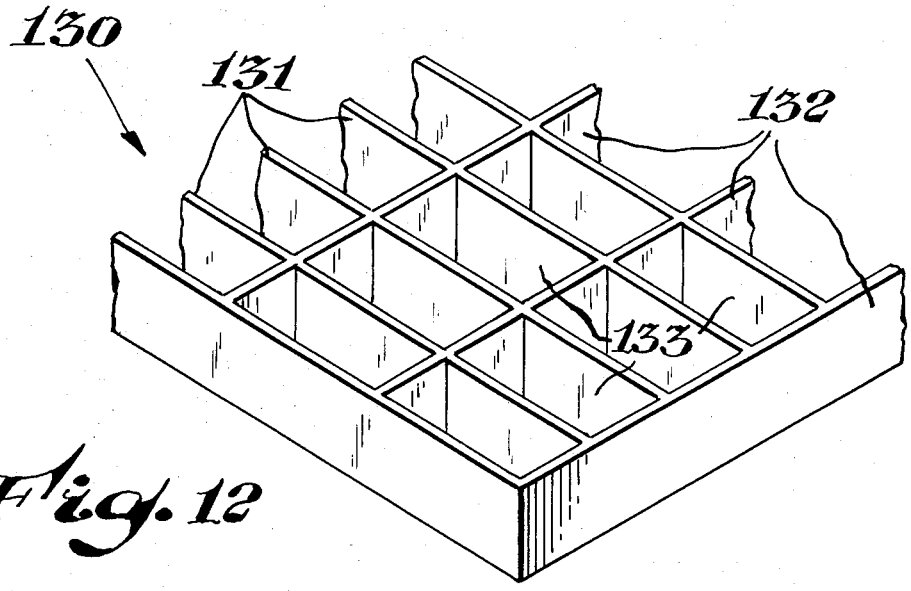
FIG. 12 is a fractional isometric view of a reticulate sheet useful in the practice of the present invention having generally rectangular cells.

In FIG. 12 there is schematically depicted a fractional sectional isometric view of an alternate reticulate sheet useful in the practice of the present invention generally designated by the reference numeral 130. The sheet 130 comprises a first plurality of bar-like elements 131 and a second plurality of bar-like elements 132, the elements 131 being disposed in generally parallel relationship to each other as are the bar-like elements 132. The bar-like elements 131 are spaced considerably closer together than the elements 132 to thereby define a plurality of elongate rectangular passageways 133, extending from one major surface of the sheet to the second major surface of the sheet in the manner of the passageways of the reticulate sheet of FIG. 4.

Figure 13:
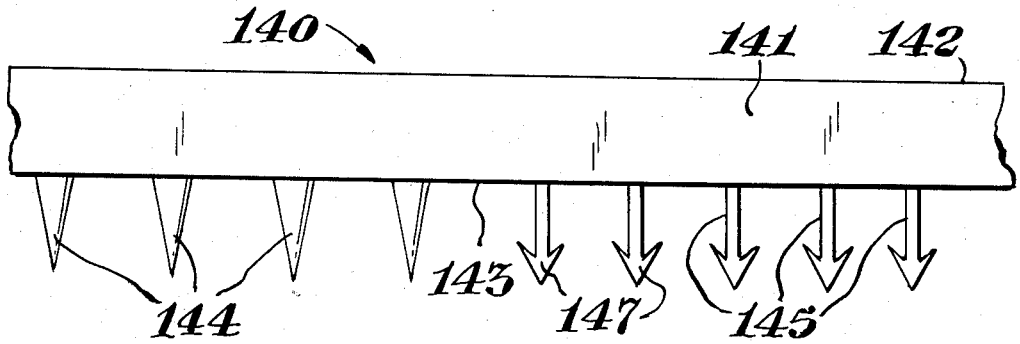
FIG. 13 is a fractional side view of a reticulate sheet in accordance with the invention showing two varieties of foam engaging members.

In FIG. 13 there is depicted schematically an edge view of a reticulate sheet useful for the practice of the present invention generally designated by the reference numeral 140. The reticulate sheet 140 comprises a plurality of elements 141 and elements not shown forming a reticulate sheet of the general nature depicted in FIGS. 4–12. The sheet 140 has an upper surface 142 and a lower surface 143. The sheet 140 has affixed thereto a plurality of generally conical foam penetrating elements 144. The elements 144 are affixed to the sheet 140 at a location generally adjacent the lower surface 143 and project outwardly from the sheet 140. The foam engaging elements 144 have a major dimension generally adjacent the sheet 140 and a minor dimension remote therefrom. The elements 144 are adapted to be forced into a synthetic resinous cellular or foam layer such as the layer 51 of FIG. 2 or layer 61 of FIG. 3 and maintain the reticulate sheet 140 in generally fixed relationship thereto, when relative force is applied to the foam sheet in a direction of the plane of the reticulate sheet 140.

Depicted also in FIG. 13 are alternate foam engaging means designated by the reference numeral 145. The foam engaging means 145 each comprises a generally cylindrical post member 146 projecting outwardly from the surface 143 of the sheet 140. The post members 146 remote from the sheet 143 terminate in barb members 147; the barb members 147 affixed to the post members 146 at a location remote from the reticulate sheet 140; the barb members 147 extending outwardly from the post members 146 and toward the surface 143 of the sheet 140. The members 145 are useful in situations where it is desirable that the reticulate sheet such as sheet 140 be affixed to the insulating layer such as the insulating layers 51 of FIG. 2 and 61 of FIG. 3 and relative displacement of the two layers be resistant regardless of which direction force is applied to the layers.

In the practice of the present invention, it is essential and critical that the insulating layer be of a closed cell configuration, the particular density or physical strength need only be sufficient to meet the insulating need and the mechanical demands of the particular installation. For most applications, foamed polystyrene sheets having a density of from about 1 to about 2.5 pounds per cubic foot are adequate for many roof installations. For a given loading of foot traffic, as the density of the foam is decreased, the thickness or strength of the cementitious layer must be increased. The selection of foam thickness and cementitious layer thickness is generally governed by conventional economic factors which generally vary from location to location. A combination which is desirable for many roof applications utilizes a laminate having a foam thickness of about 1.5 inches and a cementitious layer thickness of about 0.5 inch. The particular cementitious material employed is generally one selected which provides adequate weather resistance for the particular climate in which it is used. Highly desirable cementitious compositions are set forth in U.S. Pat. Nos. 4,054,691 and 4,067,164, the teachings of which are herewith incorporated by reference thereto. Some other variations of roofing construction which add desirable factors to a roof in accordance with the present invention are found in U.S. Pat. No. 4,351,138, the teachings of the foregoing patents being herewith incorporated by reference thereto. The reticulate sheets utilized in the cementitious layers of the panels of the present invention can be prepared from a wide variety of materials including sheet stainless steel, synthetic resinous materials such as epoxy resins with or without filamentary reinforcing therein, such as glass fibers and the like, thermoplastic resins such as polystyrene, polymethylmethacrylate, polycarbonates, polyphenylene ethers, the choice of the particular material being primarily cost performance dependent at the time of installation. A particularly desirable cost effective reinforcing grid or reticulate sheet is an injection molded styrene polymer sheet specifically designed for use in light diffusers. The configuration of the reticulate sheet is generally equivalent to that depicted in FIGS. 4 and 5 but without the bulbous portions 86. The bar-like members making up the reticulate sheet have a maximum thickness of about 0.064 inch. A minimum thickness or tapering to 0.51 inch having square openings on centers of about 0.56 inch. The reticulate sheet having a thickness of about 0.53 to about 0.356 inch. The resultant sheet has an open area of about 75 percent of the total area of the sheet. Such reticulate sheets at present are available as used in light diffusers but eminently satisfactory for the practice of the present invention. In the event the configuration such as is depicted in FIG. 3 is employed, it is usually desirable that the polymeric composition of such grids be resistant to ultraviolet light. Such resistance is readily accomplished by incorporation of pigments such as carbon black, iron ore and the like materials, well known to those skilled in the art. Panels in accordance with the present invention are found to be eminently satisfactory for the preparation of insulated flat roofs subject to foot traffic.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. In a laminate of an inorganic mortar and a closed cell synthetic resinous layer of generally planar configuration wherein a cementitious layer is affixed to a synthetic resinous foam layer to provide a laminate generally resistant to foot traffic when the cementitious layer is positioned in an uppermost position, the improvement which comprises incorporating within the cementitious layer a reticulate sheet, the sheet having a plurality of openings defined therein wherein the area of the openings is from about 50 to 98 percent of the area of the major surface of the reticulate sheet, the openings extending between first and second major surfaces of the reticulate sheet, a plurality of foam engaging means projecting outwardly from the sheet to thereby affix the reticulate sheet to the resinous layer.

2. The laminate of claim 1 wherein the reticulate sheet is a synthetic resinous reticulate sheet.

3. The laminate of claim 2 wherein the reticulate sheet is a thermoplastic synthetic resinous sheet.

4. The laminate of claim 3 wherein the reticulate sheet defines a plurality of generally rectangular openings.

5. The laminate of claim 3 wherein the sheet defines a plurality of circular openings.

6. The laminate of claim 3 wherein the reticulate sheet defines mechanical interlocking means for the inorganic mortar.

7. The laminate of claim 1 including a roof deck having disposed thereon a water impermeable membrane, the laminate being disposed over the membrane wherein the cementitious layer is positioned remote from the water impermeable membrane.

8. The laminate of claim 7 wherein the reticulate sheet is a synthetic resinous reticulate sheet.

9. The laminate of claim 7 wherein the reticulate sheet is a thermoplastic synthetic resinous sheet.

10. The laminate of claim 7 wherein the reticulate sheet defines a plurality of generally rectangular openings.

11. The laminate of claim 7 wherein the sheet defines a plurality of circular openings.

12. The laminate of claim 7 wherein the reticulate sheet defines mechanical interlocking means for the inorganic mortar.

* * * * *